United States Patent [19]

Hallings et al.

[11] Patent Number: 4,916,597

[45] Date of Patent: Apr. 10, 1990

[54] LIGHTHEAD ASSEMBLY

[75] Inventors: Leonard L. Hallings; Donald W. Bramer; Bruce A. Sanborn, all of Rochester, N.Y.

[73] Assignee: MDT Corporation, Rochester, N.Y.

[21] Appl. No.: 319,047

[22] Filed: Mar. 6, 1989

[51] Int. Cl.[4] ..... F21S 1/14

[52] U.S. Cl. ..... 362/233; 362/33; 362/287; 362/804

[58] Field of Search ..... 362/33, 233, 269, 271, 362/287, 428, 804

[56] References Cited

U.S. PATENT DOCUMENTS

| | | | |
|---|---|---|---|
| 1,909,947 | 5/1933 | Greppin | 362/275 |
| 3,005,087 | 10/1961 | Klein | 362/33 |
| 3,887,801 | 6/1975 | Ilzig et al. | 362/33 |
| 4,316,237 | 2/1982 | Yamada et al. | 362/804 X |

*Primary Examiner*—Stephen F. Husar

*Attorney, Agent, or Firm*—Trask, Britt & Rossa

[57] ABSTRACT

A lighthead assembly includes a plurality (three) individual pods with spotlights pivotally mounted symmetrically around an adjustment post. The post carries cam surfaces linked to the pods for synchronous tilting of the pods by rotation of the post. The post may be rotated directly by an axial handle or remotely by means of mechanical linkage.

14 Claims, 1 Drawing Sheet

LIGHTHEAD ASSEMBLY

BACKGROUND OF THE INVENTION

1. Field:

This invention relates to lightheads containing multiple individual spotlights. It is specifically directed to means for adjusting the direction of light beams emanating from such individual spotlights, and provides an improved mechanism for synchronizing the movement of the individual spotlights from one or more remote locations.

2. State of the Art:

Lighthead assemblies with multiple individual spotlights have long been used to provide a substantially shadowless illumination of a work area. A classic application of such assemblies is for the illumination of surgical operating sites. Lighthead assemblies with multiple spotlights evolved as an improvement over earlier operating room lighting fixtures which included expedients to scatter or diffuse the light from a single source. U.S. Pat. No. 1,909,947 illustrates an early arrangement of two spotlights with synchronized adjustment means. According to that arrangement, rotation of a central handle moves linkage structure which tilts the individual spotlights to change the direction of the light beams emanating therefrom. The light beams are thus caused to intersect (converge) at a selected distance from the spotlights. In this fashion, the shadow cast upon the illuminated area is reduced as compared to the shadow inherent with single source illumination. U.S. Pat. No. 3,055,087 discloses a more refined multi-beam lighthead assembly which provides synchronous orientation of a plurality of light beams by means of a cylindrical ring coupled by cam slots to individual spotlights arranged around the perimeter of the ring. U.S. Pat. No. 3,887,801 discloses another multi-beam lighthead assembly with a synchronized focusing mechanism. In this arrangement, a central cam ring is rotated by a handle axially disposed with respect to the assembly. The disclosures of U.S. Pat. Nos. 3,005,087 and 3,887,801 are incorporated by reference as portions of this disclosure for their detailed discussions of surgical lights with adjustable multi-beam lighthead assemblies, the objectives of such assemblies, and the mechanical linkages heretofore relied upon to effect synchronous linear shifting of the light beams emanating from multiple spotlights within the lighthead.

The various lighthead assemblies in current use have certain limitations and disadvantages. In a surgical setting, it is important for scrubbed personnel who are actually involved in a surgical procedure to be able to adjust (focus) the illumination resulting from the intersecting individual light beams. For this purpose, a centrally disposed handle, usually oriented parallel the central axis of the lighthead, is optimal. Such a handle must be capable of sterilization, and cannot be permitted to become contaminated during a procedure without imposing the concurrent constraint on scrubbed personnel of avoiding further handle contact. In many instances, however, it is either necessary or convenient for non-scrubbed personnel to focus the illumination while the surgical procedure is in progress. Such personnel cannot be permitted to contact a focusing handle which is required to remain uncontaminated. Currently available lighthead assemblies are not sufficiently adaptable to accommodate to these conflicting demands.

SUMMARY OF THE INVENTION

The multiple beam lighthead assembly of this invention includes a lighthead and associated handle structure external said lighthead. The handle structure is linked to individual spotlights housed within the lighthead, and constitutes means for focusing illumination produced by the lighthead.

The lighthead includes a plurality of structurally similar pods, each of which includes a lamp, and may also include associated lenses, filters, reflectors and/or associated mechanical and/or electronic components. In any event, each pod may be regarded as including a spotlight which produces a light beam when the lighthead is energized.

Typically, the lighthead includes a centrally disposed adjustment mechanism constructed and arranged to present a downwardly-directed focusing handle in approximately axial alignment with respect to the lighthead. Ordinarily, the lighthead will deliver light through an approximately planar platform surface of a face plate disposed between the pods and the focusing handle. For purposes of this disclosure, a reference line extending from the geometric center of the lighthead in a direction approximately normal that planar surface is regarded as the central axis of the lighthead.

A multiplicity of peripheral pods are mounted symmetrically around the central axis on pivot mounts. The peripheral pods are constructed and arranged to produce light beams, when the lighthead is energized, in a symmetrical pattern with respect to the central axis. In most instances, the peripheral pods are arranged to produce light beams which project a regular geometric shape, the center of which is intersected by the central axis. The pivot mounts permit displacement of the pods (or at least the portion of the pods including the lamps) within a range of movement. By displacing the peripheral pods a selected amount, the light beams emanating therefrom are caused to intersect (converge with) each other along the central axis at a corresponding resultant location (the illuminated area). Movement of the intersection point (region of convergence) along the central axis is regarded as "focusing" within the context of this disclosure.

Coordination means disposed within the lighthead provide synchronized movement of the peripheral pods. Each pod is thus displaced an equivalent amount to assure that all peripheral light beams simultaneously intersect at the same location along the central axis throughout the entire range of movement permitted by the respective pivot mounts. The coordination means may take various forms. As currently preferred, it includes a rotatable cylindrical surface element and reaction means operably associated with each peripheral pod and the cylindrical surface element. The surface element constitutes or otherwise carries a camming surface means (slots, grooves, ramps, bosses, etc.) and is mounted to rotate on an axis approximately parallel (typically congruent with) said central axis. The reaction means pivots (displaces) the pods in a first direction in response to clockwise rotation of the cylindrical surface element and in a second direction opposite the first direction in response to counterclockwise rotation of that element. Although the cylindrical surface element may comprise a surface of an upstanding cylindrical tube or post disposed parallel to or congruent with the central axis, the term "cylindrical," is intended in this disclosure to include any mechanically equivalent configuration which provides a synchronous link between the focusing handle and other elements of the structure relied upon for movement of the peripheral pods.

Also housed within the lighthead are all, or a major portion, of the mechanical components required to rotate the cylindrical surface element. These components constitute drive means and are mechanically coupled to the cylindrical surface element as well as to external handle structure. As presently envisioned, a single shaft may be journaled through the lighthead face plate with a first end comprising external handle structure and the opposite end comprising the cylindrical surface element.

A significant feature of the preferred embodiments of this invention is the provision of separate handle structures for use by scrubbed personnel from a first location and unscrubbed personnel from a second location remote from the first location. The first, or sterile, handle typically is connected to a downwardly projecting drive shaft congruent with the central axis. This location of the handle is a non-illuminated area, and thus induces no shadow. The second, or non-sterile, handle is typically located at the perimeter of the lighthead for ready, non-interfering access. Ideally, at least the first handle is removable and either sterilizable or disposable.

BRIEF DESCRIPTION OF THE DRAWING

The drawing, which illustrates what is currently regarded as the best mode for carrying out the invention, is an exploded view, partially in perspective of a lighthead embodying the invention, with redundant internal components omitted.

DESCRIPTION OF THE ILLUSTRATED EMBODIMENT

Figure 1:
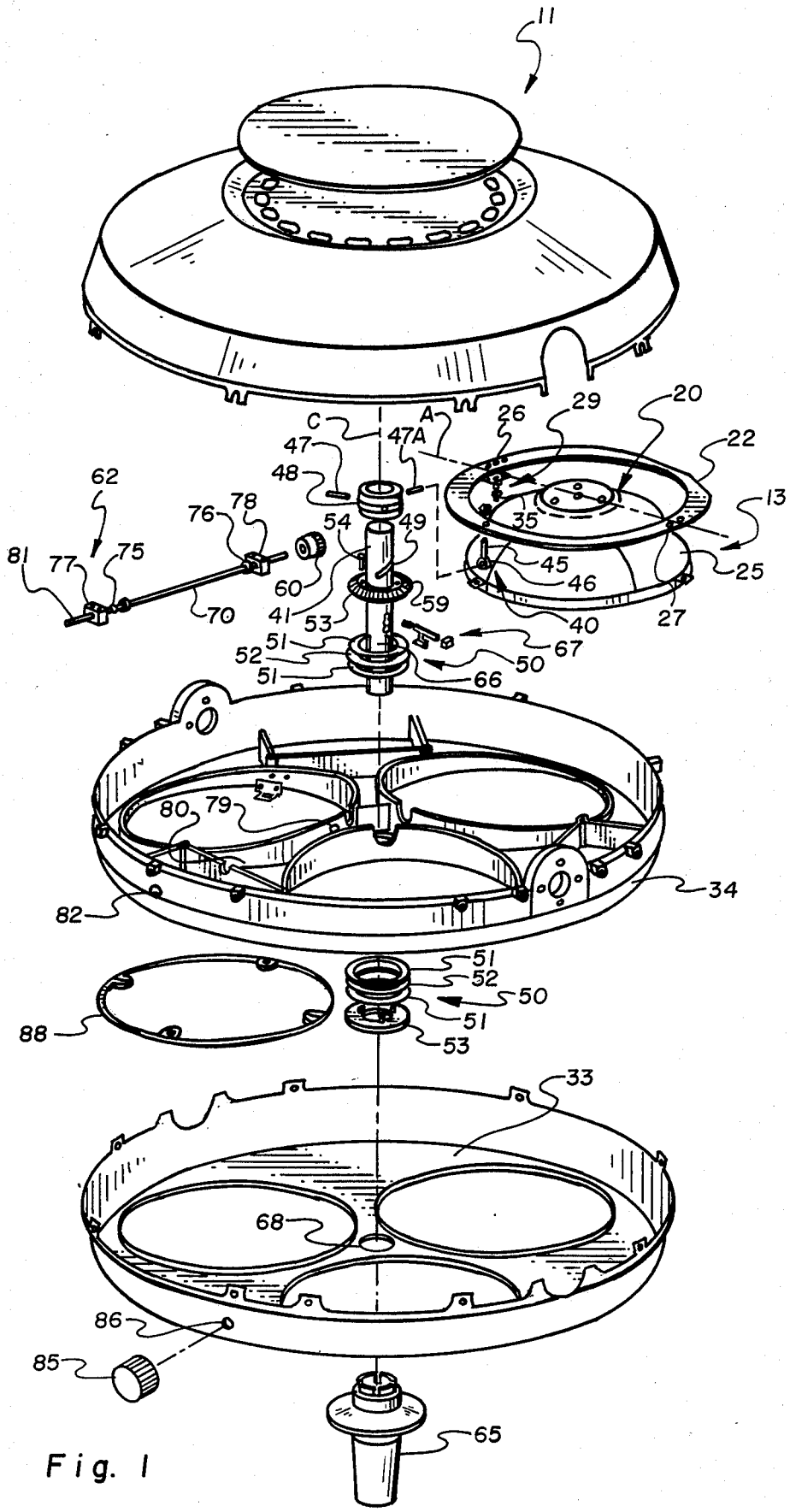

The drawing illustrates a lighthead assembly, designated generally 11, with three symmetrically arranged, substantially identical peripheral pods, designated generally 13.

Each of the pods 13 includes a spotlight assembly 20. The assemblies 20 of the peripheral pods 13 each include a circumferential support ring 22, which may be integral with, but is illustrated as a separate mounting element for, the reflector 25. The support rings 22 are supported at diametrically opposed circumferential locations 26, 27 by pivot mountings 29. The pivot mountings 29 are located to permit tilting of the mounting rings 22, and thus the reflectors 25, on an axis A which is transverse and non-intersecting with the central axis C of the lighthead 11. As illustrated, the pivot mountings 29 of all of the peripheral pods 13 define an approximately triangular figure, the center of which is intersected by the central axis C. A typical arrangement of the type illustrated permits aiming the light beam emanating from a peripheral pod 13 so that it intersects the central axis C at selected locations ranging from about 2 ½ to about 6 feet distant from the face plate 33 of the lighthead 11. The face plate 33 covers a mounting platform 34 which provides rigid mounting support for the internal components of the lighthead 11. For example, the pivot mountings 29 are supported from the platform 34 on studs 35 which may be adjustable, e.g. by threads (not shown), to constitute adjustment means.

A separate mechanical linkage, designated generally 40, couples each support ring 22 with a cam post 41. As illustrated, a threaded stud 45 extends down from the support ring 22, terminating in a ball joint connection 46 with a pin 47 carried by a cam follower ring 48. The ring 48 is dimensioned to reciprocate upon the cam post 41. The ball joint connector 46 illustrated constitutes a presently preferred self-aligning bearing. Individual pins 47 are cantilevered outwardly from the ring 48. One (47A) of the pins 47 extends into an inclined cam slot 49 provided in the wall of the cam post 41. As the post 41 is rotated clockwise or counterclockwise, the pins 47 are urged either up or down, respectively, thereby tilting in linear synchronized coordination the peripheral pods 13 on their respective pivot mounts 29.

The cam post 41 is journaled through the face plate 33 and mounting platform 34. It is supported by an adjustable friction bearing arrangement designated generally 50, including various thrust races 51, bearings 52, clamping discs 53 and screws 54, as shown. Rotational motion of the post is induced through a bevel gear 59 carried by or integral with the post 41. The gear 59 has teeth adapted to mesh with the corresponding teeth of a drive pinion gear 60. The pinion gear 60 constitutes a portion of a drive mechanism, indicated generally 62. Although the mechanism 62 illustrated is regarded as practical and reliable, various gear systems, friction drives, belt drives, chain drives and their respective equivalents can be substituted for the assembly shown. The invention contemplates the use of any drive means which can be adapted satisfactorily to mechanically couple with and serve to rotate the cam post 41 by means of a remote handle mechanism.

A first, sterilizable handle 65 is detachably connected to a drive post 66 segment of the cam post 41. The drive post 66 is mounted to protrude through an aperture 68 in the face plate 33.

The handle 65 is releasably connected to the drive post segment 66 by means of a spring-actuated coupling mechanism, designated generally 67. The handle 65, post 66 and mechanism 67 illustrated are disclosed in U.S. Pat. No. 4,878,156. Because the drive post 66 is integral with the cam post 41, turning of the handle 65 either clockwise or counterclockwise effects a direct corresponding movement of the cam slot 49, thereby effecting a corresponding tilting of the reflectors 25.

The cam post 41 is coupled to a drive shaft 70 through the gears 59, 60. The shaft 70 is journaled through bearings 75, 76, in supports 77, 78, which mount at locations 79, 80 on support platform 34. Shaft segment 81 extends through the apertures 82, 86 and is linked to a knob 85 external to face plate 33. Rotation of the shaft 70 in either direction by the knob 85 effects a corresponding rotation of the gears 59, 60, thereby turning the cam post 41.

Relamping of the pods 13 is easily accomplished by removing a cover lens 88 in conventional fashion.

Reference herein to details of the illustrated embodiments is not intended to limit the scope of the appended claims which themselves recite those features regarded as important to the invention. It will be apparent to those skilled in the art that the benefits of the disclosed invention can be obtained by the substitution of various mechanical expedients equivalent to those specifically disclosed and illustrated. Moreover, the drawing illustrates components and assemblies which, while not specifically mentioned in the specification, will nevertheless be instructive to those of ordinary skill in the art.

What is claimed:

1. A lighthead assembly, comprising a lighthead with:

a central axis;

a multiplicity of peripheral pods, each including a lamp, said peripheral pods being mounted within said lighthead symmetrically around said central axis on pivot mounts, said peripheral pods being constructed and arranged so that when said lighthead is energized, said peripheral pods produce peripheral light beams originating symmetrically with respect to said central axis, said pivot mounts permitting displacement of said peripheral pods within a range of pivotal movement, whereby the peripheral light beams originating from said peripheral pods may be caused to intersect said central axis at selected locations corresponding to selected amounts of displacement within said range of movement;

coordination means operably associated with said peripheral pods, constructed and arranged to coordinate the pivotal movement of said peripheral pods so that all of said peripheral light beams simultaneously intersect said central axis at any said selected location throughout said range of movement;

said coordination means including a cylindrical surface rotatably mounted within said lighthead about an axis of rotation approximately parallel said central axis, said cylindrical surface element carrying camming surface means in the form of an inclined spiral surface; and reaction means, operably associated with each of said peripheral pods and said camming surface means to effect synchronized pivoting of said peripheral pods in a first direction as said cylindrical surface element is rotated clockwise and in a second direction, opposite said first direction, as said cylindrical surface element is rotated counterclockwise;

first handle means parallel said central axis coupled to, and constituting first means for rotating, said cylindrical surface element;

drive means, mechanically coupled to, and constituting second means for rotating, said cylindrical surface element; and second handle structure external said lighthead, mechanically coupled to said drive means and constituting means for actuating said drive means.

2. A lighthead assembly according to claim 1 wherein said camming surface means is selected from the group consisting essentially of slots, grooves, ramps or bosses carried by said cylindrical surface element.

3. A lighthead assembly according to claim 1 wherein said reaction means includes a cam follower ring mounted to move longitudinally with respect to said axis of rotation in response to rotation of said inclined spiral surface, said cam follower ring carrying structure interactive with cooperative structure carried by said peripheral pods.

4. A lighthead assembly according to claim 1 wherein said cylindrical surface element comprises a cylindrical post and said spiral surface comprises a slot in said post.

5. A lighthead assembly according to claim 4 including a cam follower ring constituting a portion of said reaction means, said cam follower ring being mounted external said post approximately concentric with said central axis to move longitudinally with respect to said central axis in response to rotation of said cylindrical surface element.

6. A lighthead assembly according to claim 5 including pin elements extending from attachment with said cam follower ring, said pins being mounted in operably cooperable arrangement with said structure carried by respective said peripheral pods, a first end of one of said pins engaging a said structure carried by a said pod and a second end of said one of said pins engaging said slot.

7. A lighthead assembly according to claim 6 wherein the number of said pins corresponds to the number of said peripheral pods and each said pin operably cooperates with reaction means structure carried by a respective said peripheral pod.

8. A lighthead assembly according to claim 7 wherein each said peripheral pod carries a self-aligning bearing means mounted in engagement with a respective said pin element.

9. A lighthead assembly according to claim 1 wherein said first handle is connected to a shaft mounted to turn on an axis congruent with said central axis, said shaft being integral with said cylindrical surface element.

10. A lighthead assembly according to claim 9 wherein said first handle is releasably connected to said shaft, external said lighthead.

11. A lighthead assembly according to claim 9 including a second shaft coupled to said cylindrical surface element through a gear drive assembly.

12. A lighthead assembly according to claim 11 wherein said second shaft is oriented transverse said first shaft and extends to attachment with said second handle external said lighthead.

13. A lighthead assembly according to claim 11 wherein said drive assembly is a gear drive assembly.

14. A lighthead assembly according to claim 13 wherein said second shaft is oriented transverse said first shaft and extends to attachment with said second handle external said lighthead.

* * * * *